US010261462B2

(12) United States Patent
Asami et al.

(10) Patent No.: US 10,261,462 B2
(45) Date of Patent: Apr. 16, 2019

(54) IMAGE FORMING APPARATUS

(71) Applicant: CANON KABUSHIKI KAISHA, Tokyo (JP)

(72) Inventors: Jun Asami, Susono (JP); Toshiya Kaino, Suntou-gun (JP); Ryuichi Umehara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 15/703,198

(22) Filed: Sep. 13, 2017

(65) Prior Publication Data

US 2018/0095385 A1 Apr. 5, 2018

(30) Foreign Application Priority Data

Oct. 4, 2016 (JP) ..... 2016-196666

(51) Int. Cl.

| | |
|---|---|
| ***G03G 21/00*** | (2006.01) |
| ***G03G 15/06*** | (2006.01) |
| ***G03G 15/08*** | (2006.01) |
| ***G03G 15/16*** | (2006.01) |
| ***G03G 15/24*** | (2006.01) |

(52) U.S. Cl.

CPC ..... *G03G 21/0011* (2013.01); *G03G 15/065* (2013.01); *G03G 15/0865* (2013.01); *G03G 15/169* (2013.01); *G03G 15/24* (2013.01); *G03G 21/0005* (2013.01)

(58) Field of Classification Search

CPC ..... G03G 21/0011; G03G 21/0094

See application file for complete search history.

(56) References Cited

U.S. PATENT DOCUMENTS

| | | | | |
|---|---|---|---|---|
| 9,031,430 | B2 | 5/2015 | Takayanagi | |
| 2005/0100361 | A1* | 5/2005 | Tanaka | G03G 15/751 399/101 |
| 2008/0187352 | A1* | 8/2008 | Takeuchi | G03G 15/161 399/101 |
| 2013/0156450 | A1* | 6/2013 | Hano | G03G 15/5041 399/49 |

FOREIGN PATENT DOCUMENTS

| | | | |
|---|---|---|---|
| JP | 2004-191737 | A | 7/2004 |
| JP | 2008-268767 | A | 11/2008 |
| JP | 2012-013760 | A | 1/2012 |
| JP | 2013-140293 | A | 7/2013 |

* cited by examiner

*Primary Examiner* — Carla J Therrien
(74) *Attorney, Agent, or Firm* — Venable LLP

(57) ABSTRACT

An image forming apparatus includes a control unit that causes a supply operation to form a predetermined toner image and supplies toner of the predetermined toner image to a contact portion between a cleaning member and a photosensitive member at a non-image forming time. During at least a period in which toner of the predetermined toner image on the photosensitive member passes through a transfer unit during the supply operation, the control unit causes application of a pass-through voltage having the same polarity as a normal charge polarity of the toner and an absolute value that is less than an electric potential of a portion that is exposed by an exposure device of the photosensitive member, or having a reverse polarity that is reverse to the normal charge polarity of the toner to be applied from the transfer power supply to the transfer member.

4 Claims, 7 Drawing Sheets

IMAGE FORMING APPARATUS

BACKGROUND OF THE INVENTION

Field of the Invention

The present invention relates to an image forming apparatus such as a copier, a printer or a facsimile machine that uses an electrophotographic method or an electrostatic recording method.

Description of the Related Art

Conventionally, in image forming apparatuses using an electrophotographic method or an electrostatic recording method, residual toner remaining on an image bearing member after a toner image is transferred from the image bearing member onto a recording material is removed with a cleaning member that is disposed in contact with the image bearing member. In many cases a cleaning blade is used as the cleaning member. The cleaning blade is generally caused to contact against the image bearing member so as to be in the counter direction to the direction of movement of the image bearing member, and a frictional force between the cleaning blade and the image bearing member is liable to become excessive. If the lubricity of a contact portion between the cleaning blade and the image bearing member decreases, "burring" in which the tip of the cleaning blade is turned up in the direction of movement of the image bearing member, abnormal vibrations referred to as "chattering", or unusual noises referred to as "squealing" or the like sometimes occur. Furthermore, in some cases "chipping" in which a part of the tip of the cleaning blade becomes chipped also occurs. If these problems occur, the capacity to clean the image bearing member by means of the cleaning blade decreases, and the service life of the cleaning blade or the image bearing member is shortened.

Japanese Patent Application Laid-Open No. 2004-191737 discloses a method that, at a non-image forming time, forms a band-like toner image (hereunder, also referred to as a "toner band") on an image bearing member and supplies the toner of the toner band to a contact portion between a cleaning blade and the image bearing member. According to this method, the toner and an additive agent of the toner are interposed between the cleaning blade and the image bearing member and the toner and additive agent act as lubricants and thereby decrease a frictional force between the cleaning blade and the image bearing member, and thus the occurrence of the above described problems can be suppressed.

However, if a toner band is formed on an image bearing member at a non-image forming time, the toner of the toner band sometimes flies off from the image bearing member and scatters, and members such as a conveyance guide that forms a conveyance path for recording material in the vicinity of the transfer unit are smeared by the scattered toner. Further, if the amount of toner smeared on the aforementioned members is large, in some cases recording material that passes along the conveyance guide is also smeared by the toner.

In order to reduce the amount of toner that flies off and scatters from the image bearing member, it is conceivable to reduce the amount of toner of the toner band or to slow down the movement speed of the image bearing member during an operation to form the toner band. However, in such cases it will be necessary to increase the frequency for executing an operation to form a toner band, or the downtime (as a period when an image cannot be output) required for an operation to form a toner band will become longer.

SUMMARY OF THE INVENTION

One aspect of the present invention is an image forming apparatus that can suppress the occurrence of smearing of members in the vicinity of a transfer unit by toner that is caused by an operation to supply toner to a contact portion between a cleaning member and an image bearing member at a non-image forming time.

Another aspect of the present invention is an image forming apparatus including a photosensitive member, a charge device configured to charge the photosensitive member, an exposure device configured to expose the photosensitive member that is charged and form an electrostatic image, a developing device configured to supply toner to the electrostatic image to form a toner image, a transfer member configured to cause a toner image to be transferred from the photosensitive member onto a recording material at a transfer unit, a transfer power supply configured to apply a voltage to the transfer member, a cleaning member disposed in contact with the photosensitive member, the cleaning member configured to remove toner adhering to the photosensitive member, and a control unit configured to cause a supply operation that forms a predetermined toner image on the photosensitive member and supplies toner of the predetermined toner image to a contact portion between the cleaning member and the photosensitive member to be executed, at a non-image forming time, wherein at least during a period in which toner of the predetermined toner image on the photosensitive member passes through the transfer unit during the supply operation, the control unit causes a pass-through voltage that is a voltage having a same polarity as a normal charge polarity of the toner and whose absolute value is less than an electric potential of a portion that is exposed by the exposure device of the photosensitive member to be applied from the transfer power supply to the transfer member.

A further aspect of the present invention is an image forming apparatus including a photosensitive member, a charge device configured to charge the photosensitive member, an exposure device configured to expose the photosensitive member that is charged and form an electrostatic image, a developing device configured to supply toner to the electrostatic image to form a toner image, a transfer member configured to cause a toner image to be transferred from the photosensitive member onto a recording material at a transfer unit, a transfer power supply configured to apply a voltage to the transfer member, a cleaning member disposed in contact with the photosensitive member, the cleaning member configured to remove toner adhering to the photosensitive member, and a control unit configured to cause a supply operation that forms a predetermined toner image on the photosensitive member and supplies toner of the predetermined toner image to a contact portion between the cleaning member and the photosensitive member to be executed, at a non-image forming time, wherein at least during a period in which toner of the predetermined toner image on the photosensitive member passes through the transfer unit during the supply operation, the control unit causes a pass-through voltage that is a voltage with a reverse polarity to a normal charge polarity of the toner to be applied from the transfer power supply to the transfer member, and the control unit causes a change of the pass-through voltage according to a change in an electric potential of a portion that is exposed by the exposure device of the photosensitive member.

A still further aspect of the present invention is an image forming apparatus including a photosensitive member, a charge device configured to charge the photosensitive member, an exposure device configured to expose the photosensitive member that is charged and form an electrostatic image, a developing device configured to supply toner to the electrostatic image to form a toner image, a transfer member configured to cause a toner image to be transferred from the photosensitive member onto a recording material at a transfer unit, a transfer power supply configured to apply a voltage to the transfer member, a cleaning member disposed in contact with the photosensitive member, the cleaning member configured to remove toner adhering to the photosensitive member, a guide member disposed on an upstream side of the transfer unit in a conveyance direction of a recording material, the guide member configured to regulate a conveyance trajectory of a recording material that is conveyed to the transfer unit, and a control unit configured to cause a supply operation that forms a predetermined toner image on the photosensitive member and supplies toner of the predetermined toner image to a contact portion between the cleaning member and the photosensitive member to be executed, at a non-image forming time, wherein the control unit causes application of a pass-through voltage to be larger than an electric potential of the guide member on a side of a reverse polarity to a normal charge polarity of the toner, from the transfer power supply to the transfer member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereunder, an image forming apparatus according to the present invention is described in further detail in accordance with the accompanying drawings.

Embodiment 1

1. Overall Configuration and Operations of Image Forming Apparatus

Figure 1:
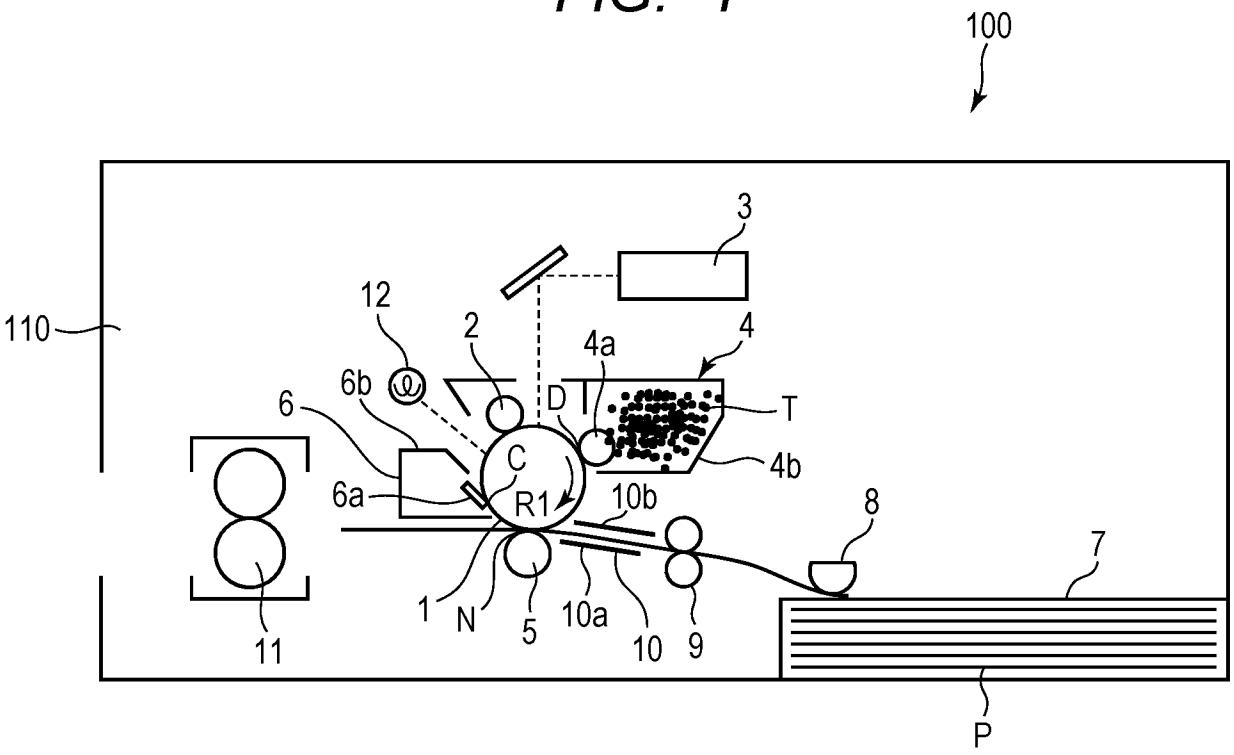
FIG. 1 is a schematic cross-sectional view of an image forming apparatus.

FIG. 1 is a schematic cross-sectional view of an image forming apparatus 100 of the present embodiment. The image forming apparatus 100 of the present embodiment is a laser printer that uses an electrophotographic method.

The image forming apparatus 100 has a photosensitive drum 1 which is a drum-type (cylindrical) photosensitive member (electrophotographic photosensitive member) as an image bearing member capable of rotating and bearing a toner image. The photosensitive drum 1 is rotationally driven at a predetermined peripheral velocity (process speed) in an arrow R1 direction (clockwise) in the figure by a driving motor (not illustrated in the drawing) as a driving unit. In the present embodiment, the process speed is 385 mm/sec. The surface of the rotating photosensitive drum 1 is uniformly charged to a predetermined potential having a predetermined polarity (a negative polarity in the present embodiment) by a charging roller 2 that is a roller-type charging member as a charge device. During a charging process, a predetermined charging bias (charging voltage) is applied to the charging roller 2 from an unshown charging power supply (high voltage power supply circuit). The surface of the photosensitive drum 1 that was charged is subjected to scanning exposure by an exposure apparatus 3 as an exposure device to thereby form an electrostatic latent image (electrostatic image) on the photosensitive drum 1. In the present embodiment, the exposure apparatus 3 is a scanner unit that includes a laser light source, a polygon mirror and a lens system. The exposure apparatus 3 irradiates the surface of the photosensitive drum 1 with a laser beam that is modulated in accordance with an image signal. In the present embodiment, a charging potential (dark portion potential, non-image portion potential) VD generated by the charging roller 2 of the photosensitive drum 1 is −500V, and an exposed portion potential (bright portion potential, image portion potential) VL generated by the exposure apparatus 3 is −100V.

The electrostatic latent image that is formed on the photosensitive drum 1 is developed (visualized) using toner as developer by a developing apparatus 4 as a developing device to thereby form a toner image on the photosensitive drum 1. The developing apparatus 4 includes a developing roller 4*a* as a developer bearing member, and a developer container 4*b* that supports the developing roller 4*a* and also stores toner. The developing roller 4*a* carries toner T that was stored inside the developer container 4*b* and transports the toner T to a developing unit D that is a portion where the developing roller 4*a* and the photosensitive drum 1 face each other, and supplies toner to the photosensitive drum 1 in accordance with the electrostatic latent image on the photosensitive drum 1. At the time of the development process, a predetermined developing bias (developing voltage) is applied to the developing roller 4*a* from an unshown developing power supply (high voltage power supply circuit). In the present embodiment, toner that was charged with the same polarity (negative polarity in the present embodiment) as the charge polarity of the photosensitive drum 1 adheres to the exposed portion on the photosensitive drum 1 at which the absolute value of the potential decreased as a result of being exposed after the photosensitive drum 1 was uniformly charged. In the present embodiment, the charge polarity (normal charge polarity) of the toner at the time of development is a negative polarity.

A transfer roller 5 that is a roller-shaped transfer member is disposed as a transfer device facing the photosensitive drum 1. The transfer roller 5 is pressed into contact with the photosensitive drum 1, and a transfer unit N is formed by contact between the photosensitive drum 1 and the transfer roller 5. A toner image that was formed on the photosensitive drum 1 is transferred at the transfer unit N onto a recording material P such as paper that is pinched and conveyed by the photosensitive drum 1 and the transfer roller 5. At the time of the transfer process, a transfer bias (transfer voltage) that is a direct-current voltage (in the present embodiment, a positive polarity) having a reverse polarity to the normal charge polarity of toner from a transfer power supply 21 (FIG. 2) is applied to the transfer roller 5.

The recording material P is stored in a cassette 7 as a recording material storage unit, and is conveyed as far as registration rollers 9 by a feed roller 8. The recording material P is fed by the registration rollers 9 to the transfer unit N in a manner in which the timing of feeding the recording material P matches a position of the toner image on the photosensitive drum 1 to the transfer unit N. A conveyance guide 10 as a guide member that forms a conveyance path of the recording material P to be conveyed to the transfer unit N and that regulates the conveyance trajectory of the recording material P is provided at a location that is on the upstream side of the transfer unit N and on the downstream side of the registration rollers 9 in the conveyance direction of the recording material P. The conveyance guide 10 has a downstream guide unit 10*a* that regulates movement of the recording material P to the downward side in the gravitational direction and an upstream guide unit 10*b* that regulates movement of the recording material P to the upward side in the gravitational direction, and a conveyance path of the recording material P is formed between the downstream guide unit 10*a* and the downstream guide unit 10*b*.

The recording material P onto which the toner image was transferred is conveyed to a fixing apparatus 11 as a fixing unit, and after the toner image is fixed (fused and fixed) by being heated and pressurized by the fixing apparatus 11, the recording material P is discharged (output) to outside of an apparatus main body 110 of the image forming apparatus 100.

Residual toner remaining on the surface of the photosensitive drum 1 after the transfer process is removed from the surface of the photosensitive drum 1 and collected by a cleaning apparatus 6 as a cleaning unit. In the present embodiment, the cleaning apparatus 6 has a cleaning blade 6*a* formed of urethane rubber as one example of an elastic material, and a collection container 6*b* that supports the cleaning blade 6*a*. The cleaning blade 6*a* is caused to contact against the surface of the photosensitive drum 1 so as to contact therewith in a counter direction (a direction in which a free end of the cleaning blade 6*a* faces the upstream side of the direction of movement of the surface of the photosensitive drum 1) to the direction of movement of the surface of the photosensitive drum 1. The cleaning blade 6*a* is a plate-like (blade-like) member that has a predetermined length in each of a longitudinal direction that is substantially parallel to the direction of the rotation axis of the photosensitive drum 1, and a short-side direction that is substantially orthogonal to the longitudinal direction, and has a predetermined thickness. The length of the cleaning blade 6*a* in the longitudinal direction is equal to or greater than the length of an image formation region (region in which formation of a toner image is possible) in the direction of the rotation axis of the photosensitive drum 1, and the image formation region falls within the range of the length in the longitudinal direction of the cleaning blade 6*a*. The cleaning apparatus 6 scrapes the residual toner from the surface of the rotating photosensitive drum 1 by means of the cleaning blade 6*a*, and collects the toner that was scraped off in the collection container 6*b*.

Further, a pre-exposure apparatus 12 as a static charge eliminating unit that eliminates at least some of the electrical charge on the photosensitive drum 1 is provided at a position that is on the downstream side of the cleaning apparatus 6 and on the upstream side of the charging roller 2 in the rotational direction of the photosensitive drum 1. The pre-exposure apparatus 12 irradiates light from a light source such as an LED or a halogen lamp onto the surface of the photosensitive drum 1 to make the electric potential on the surface of the photosensitive drum 1 substantially even.

In the present embodiment, the photosensitive drum 1, and the charging roller 2, the developing apparatus 4 and the cleaning apparatus 6 as process units that act on the photosensitive drum 1 constitute a process cartridge (hereunder, also referred to as "cartridge") 25 (FIG. 3) that is detachably mountable to the apparatus main body 110 in an integral manner.

In the present embodiment, a toner image forming unit that forms a toner image on the photosensitive drum 1 is constituted by the charging roller 2, the exposure apparatus 3 and the developing apparatus 4.

Further, in the present embodiment, operations of each unit of the image forming apparatus 100 are controlled by a controller 27 (FIG. 3) as a control unit provided in the apparatus main body 110. The controller 27 includes a calculation control unit (CPU) and a memory unit (ROM, RAM), and the calculation control unit performs overall control of the respective units of the image forming apparatus 100 in accordance with a program and data stored in the memory unit.

The image forming apparatus 100 executes a series of image output operations (job, print operation) for forming an image on one or a plurality of the recording materials P and outputting the resulting recording material(s) P that is started by one start instruction. The job generally includes an image forming process, a prerotation process, a sheet interval process when an image is to be formed on a plurality of the recording materials P, and a post-rotation process. The image forming process is a time period for performing formation of an electrostatic latent image of the image to be actually formed and output onto the recording material P, formation of a toner image, and transfer of the toner image, and the term "image forming time" refers to this period. More specifically, the timing of the aforementioned image forming time differs depending on the positions at which the respective processes of the formation of the electrostatic latent image, the formation of the toner image, and the transfer of the toner image are performed. The prerotation process is a time period for performing a preparation operation prior to the image forming process, and is a period of time from when a start instruction is input until formation of the image actually starts. The sheet interval process is a time period corresponding to an interval between one recording material P and a next recording material P when image forming is consecutively performed with respect to a plurality of the recording materials P (consecutive image forming). The post-rotation process is a time period for performing an arrangement operation (preparation operation) after the image forming process. The term "non-image forming time" refers to a period other than a period at an image forming time, and includes the aforementioned pre-rotation process, sheet interval process, post-rotation process and, furthermore, a time of a pre-multi-rotation process which is a preparation operation when the power of the image forming apparatus 100 is turned on or when reverting from a sleep state and the like.

2. Transfer Process

Figure 2:
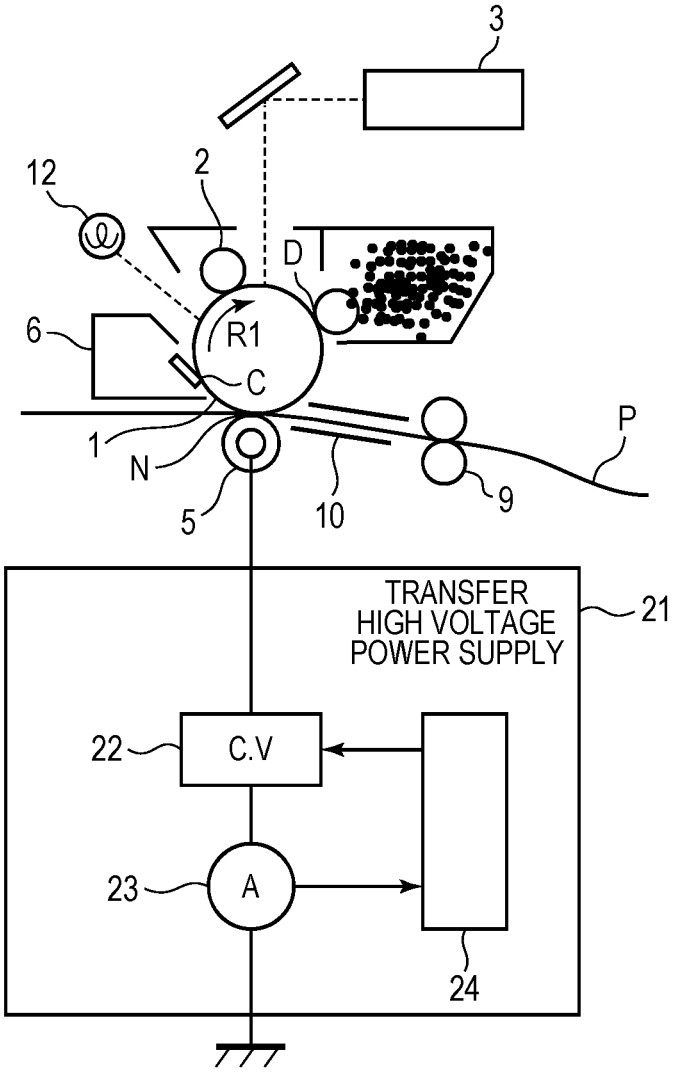
FIG. 2 is a schematic diagram for describing a transfer process.

FIG. 2 is a schematic diagram for describing the transfer process. A transfer power supply (high voltage power supply circuit) 21 is connected to the transfer roller 5. A transfer bias that is a direct-current voltage of positive polarity is applied from the transfer power supply 21 to the transfer roller 5 in synchrony with a timing at which the toner image on the photosensitive drum 1 and the recording material P are respectively conveyed to the transfer unit N. Thereby, the toner image on the photosensitive drum 1 is transferred onto the recording material P. At the time of the transfer, a charge of a reverse polarity to the charge of the toner of the toner image is imparted by the transfer roller 5 to the rear side of the recording material P.

In the present embodiment, the transfer roller 5 is an elastic roller having an external diameter of 14 mm in which an elastic layer with a material thickness of 4.5 mm is formed on an outer circumferential surface of a metal core having an external diameter of 5 mm. In the present embodiment the metal core is formed of SUS (stainless steel), and the elastic layer is a sponge layer that is formed of an elastic material (NBR or hydrin or the like). In the present embodiment, the electrical resistance value of the transfer roller 5 was approximately $5.0\times10^7\Omega$ when measured by the following method. That is, the electrical resistance value of the transfer roller 5 was measured by bringing the transfer roller 5 into contact with an electrically grounded counter electrode with a load of 400 g weight, rotating the transfer roller 5 at a peripheral velocity of 118 mm/sec, and applying a voltage of 2.0 KV to the metal core of the transfer roller 5 and measuring the current.

In the present embodiment, the transfer power supply 21 is constituted by including a variable constant-voltage power supply 22, an ampere meter 23 and a driving circuit 24. The transfer power supply 21 is driven by control of the driving circuit 24 based on instructions of the controller 27. The variable constant-voltage power supply 22 is configured to be capable of outputting voltages of both positive and negative polarities. The transfer power supply 21 can output a voltage that is subjected to constant voltage control from the variable constant-voltage power supply 22, and can output a voltage subjected to constant current control by changing the output of the variable constant-voltage power supply 22 so that a current detected by the ampere meter 23 becomes a predetermined current value. In the present embodiment, at the time of the transfer process, and at the time of a supply operation (purge treatment) that is described later, the transfer power supply 21 outputs the voltage that is subjected to constant voltage control. However, the present invention is not limited thereto, and at the time of the transfer process, and at the time of the supply operation described hereunder, the transfer power supply 21 may output a voltage that is subjected to constant current control.

3. Supply Operation

In the present embodiment, at a non-image forming time the image forming apparatus 100 executes a supply operation that forms a band-shaped toner image (toner band) as a predetermined toner image on the photosensitive drum 1, and supplies the toner of the toner band to a contact portion C between the cleaning blade 6*a* and the photosensitive drum 1.

Figure 3:
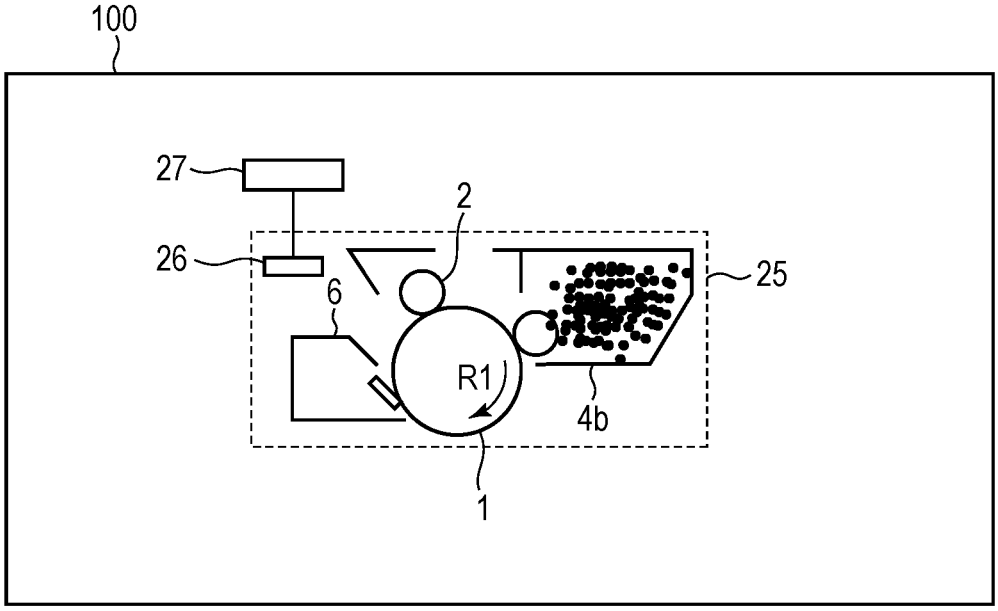
FIG. 3 is a schematic diagram for describing a supply operation.

FIG. 3 is a schematic diagram for describing the supply operation. In the present embodiment the supply operation is executed at the initial stage of using the cartridge 25, when a problem such as burring, chattering, squealing or chipping of the cleaning blade 6*a* is liable to arise. In particular, in a case where the cartridge 25 is replaced with a new cartridge, it is preferable to immediately execute the supply operation after rotational driving of the photosensitive drum 1 is started.

In the present embodiment, a memory 26 as a storage medium is provided in the cartridge 25. It is possible to input usage information (history information) showing that the cartridge 25 is a new cartridge in the memory 26. When the cartridge 25 is mounted in the apparatus main body 110, the memory 26 of the cartridge 25 is communicably connected to the controller 27 of the apparatus main body 110, and reading of information by the controller 27 with respect to the memory 26 is enabled.

In the present embodiment, as usage information, time periods for which the cartridge 25 was driven (the photosensitive drum 1 was rotated) are successively integrated and stored by the controller 27 in the memory 26. Further, in the present embodiment, the controller 27 integrates the number of printed sheets and stores the integrated value in the memory unit, and resets the value of the number of printed sheets to 0 each time the supply operation is executed. Thus, in the present embodiment, the controller 27 has a function as a new product (initial usage stage) detecting unit with respect to the cartridge 25 and a function as a number of printed sheets counting unit.

In a case where a driving time period of the cartridge 25 is not stored in the memory 26 (or a case where information to the effect that the cartridge 25 is new, such as information that the driving time period is 0, is stored in the memory 26), the controller 27 can determine that the cartridge 25 is new. Further, in a case where the driving time period of the cartridge 25 stored in the memory 26 has not reached a predetermined time period (threshold value), the controller 27 can determine that the cartridge 25 is at an initial usage stage.

Upon the start of operations of the image forming apparatus 100, the controller 27 accesses the memory 26 of the cartridge 25 to check the usage information. If the controller 27 determines that the cartridge 25 is new, the controller 27 causes the supply operation to be executed at the time of a pre-multi rotation. Further, at the start of operation of the image forming apparatus 100, at the start of a job, or each time an image is output during a job, the controller 27 accesses the memory 26 of the cartridge 25 to check the usage information. If the controller 27 determines that the cartridge 25 is at an initial usage stage, the controller 27 checks the number of printed sheets since the previous time the supply operation was executed that is stored in the memory unit. If the controller 27 determines that the number of printed sheets has reached a predetermined number of sheets (threshold value), depending on the determination timing, the controller 27 causes the supply operation to be executed at the time of a pre-multi rotation, the time of a prerotation, the time of a sheet interval or the time of a post-rotation.

Figure 4:
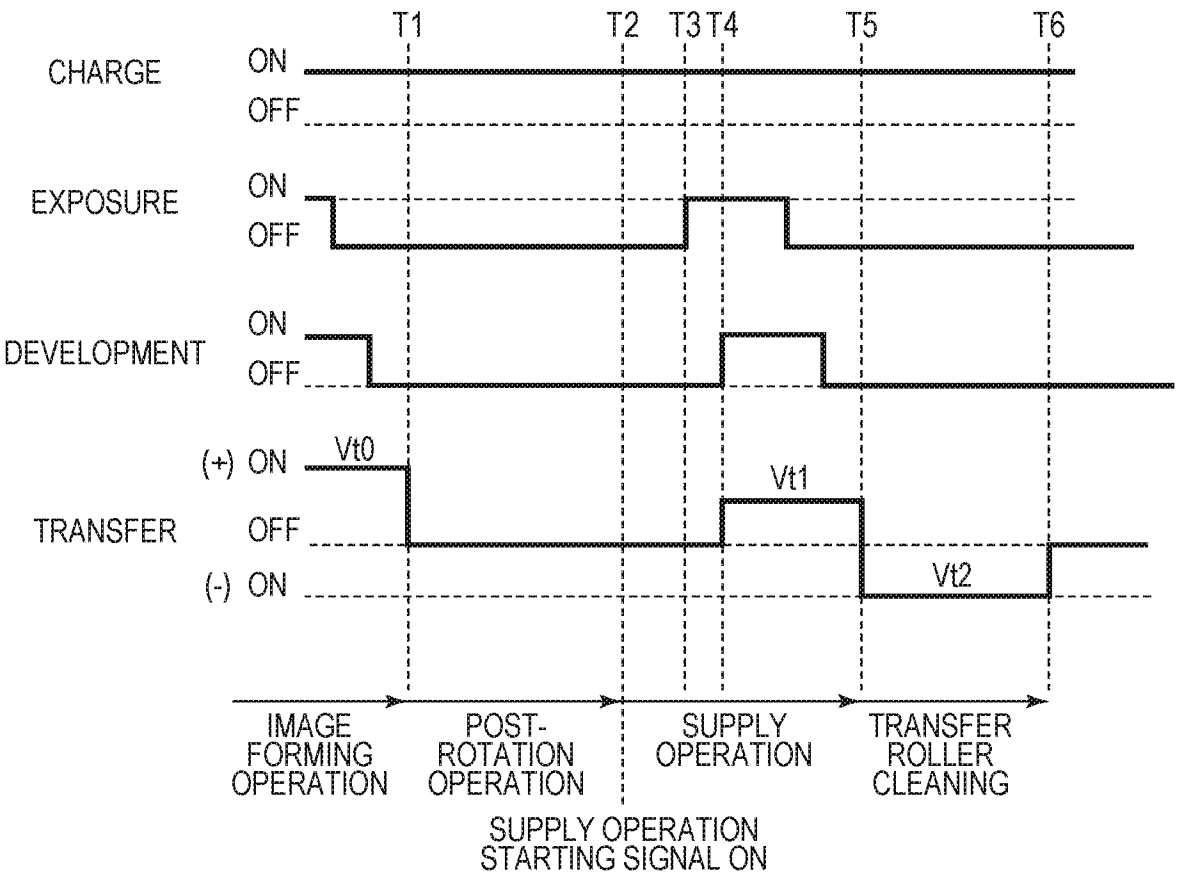
FIG. 4 is a timing chart of a supply operation.

FIG. 4 is a timing chart for describing the supply operation in the present embodiment. The operation timings of the respective parts when performing a supply operation every time 100 sheets are printed at an initial usage stage of the cartridge 25 will be described referring to FIG. 4. FIG. 4 illustrates an example in a case of executing the supply operation at a post-rotation time as a non-image forming time.

At a timing T1 after image forming ends, the controller 27 turns a transfer bias Vt0 that had been applied to the transfer roller 5 at the image forming time to "off." Further, when the controller 27 determines that the timing is a timing for executing the supply operation as described above, the controller 27 issues a supply operation starting signal at a timing T2 during post-rotation, and actuates the respective parts in the order described below to execute the supply operation.

First, at a timing T3, the controller 27 causes a band-shaped electrostatic latent image to be formed on the circumferential face of the photosensitive drum 1 under predetermined exposure conditions by the exposure apparatus 3. In the present example, at this time a predetermined charging bias is being applied to the charging roller 2 continuously from the immediately preceding image forming time. Next, at a timing T4, the controller 27 applies a developing bias to the developing roller 4*a* to develop the band-shaped electrostatic latent image on the photosensitive drum 1 and form a band-shaped toner image (toner band). In the present embodiment, the length in the longitudinal direction of the toner band (approximately parallel to the direction of the rotation axis of the photosensitive drum 1) is taken as the length across the whole area of the image formation region (210 mm in the present embodiment) in the direction of the rotation axis of the photosensitive drum 1. Further, in the present embodiment, the length in the short-side direction (circumferential direction of the photosensitive drum 1) of the toner band is taken as 90 mm. Furthermore, in the present embodiment, the toner band is assumed to be a solid image (maximum density level image). When development of the toner band ends, the developing bias is turned "off."

Substantially simultaneously with a timing T4 at which application of the developing bias is started, the controller 27 causes a predetermined pass-through bias (pass-through voltage) Vt1 that is a direct-current voltage to be applied to the transfer roller 5. The pass-through bias Vt1 will be described in further detail later. At least some of the toner of the toner band passes through the transfer unit N and is fed to the contact portion C between the cleaning blade 6*a* and the photosensitive drum 1. At a timing T5 that is simultaneous with the end of passage of the toner of the toner band on the photosensitive drum 1 through the transfer unit N or is after the toner passes therethrough, the controller 27 causes a predetermined cleaning bias Vt2 that is a direct-current voltage having the same polarity as the normal charge polarity of the toner to be applied to the transfer roller 5. Thereby, toner that adhered to the transfer roller 5 is caused to move (is discharged) to the photosensitive drum 1. This toner is at least one part of the toner of the toner band that adhered to the transfer roller 5 when the toner band on the photosensitive drum 1 passed through the transfer unit N. The toner that was moved from the transfer roller 5 to the photosensitive drum 1 is also fed to the contact portion C between the cleaning blade 6*a* and the photosensitive drum 1.

At a timing T6 after the cleaning bias (cleaning voltage) Vt2 was applied to the transfer roller 5 for a predetermined time period for causing toner to adequately move from the transfer roller 5 to the photosensitive drum 1, the controller 27 turns the cleaning bias Vt2 "off." Thereafter, the supply operation ends at a timing at which the position on the photosensitive drum 1 that passed through the transfer unit N when the cleaning bias Vt2 was turned "off" passed through the contact portion between the cleaning blade 6*a* and the photosensitive drum 1. In the present example, because image forming is to be started successively thereafter, a predetermined charging bias is applied in a continuous manner to the charging roller 2.

Note that, in the present embodiment the charging bias, developing bias and exposure conditions during the supply operation are each set to the same values as at an image forming time. The developing bias is an oscillating voltage that consists of an AC component (peak-to-peak voltage Vpp, frequency f) superimposed on a DC component (Vdc), and Vdc was set as −380V, Vpp was set as 1.8 kV, and f was set as 2.8 kHz. Further, the charging potential VD of the photosensitive drum 1 was set as −500V, and the exposed portion potential VL was set as −100V. However, setting of the developing bias, charging bias and exposure conditions during the supply operation are not limited to the settings of the present embodiment and the appropriate optimal settings may be set.

Further, in the present embodiment, the transfer bias Vt0 at an image forming time is set to +2000V, the pass-through bias Vt1 at the time of the supply operation is set to +1000V of a reverse polarity to the normal charge polarity of the toner, and the cleaning bias Vt2 is set to −1000V with the same polarity as the normal charge polarity of the toner.

Further, although FIG. 4 illustrates an example of a case of executing a supply operation at a time of a post-rotation operation, for example, in a case where the a cartridge 25 has been replaced with a new cartridge 25, the controller 27 can immediately issue a supply operation starting signal prior to execution of the initial image forming.

4. Pass-Through Bias of Supply Operation

Figure 5A:
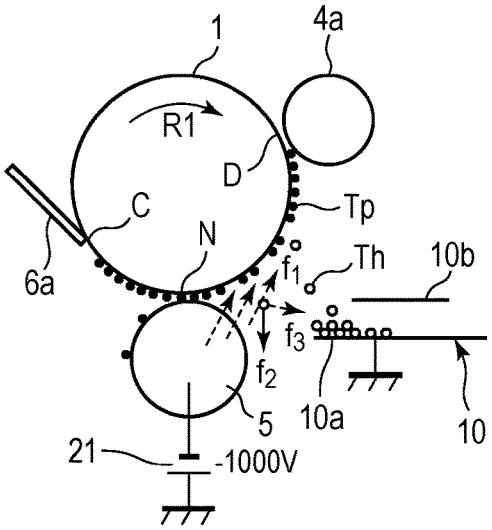
FIG. 5A, FIG. 5B and FIG. 5C are schematic diagrams for describing a working effect of one embodiment.
Figure 5B:
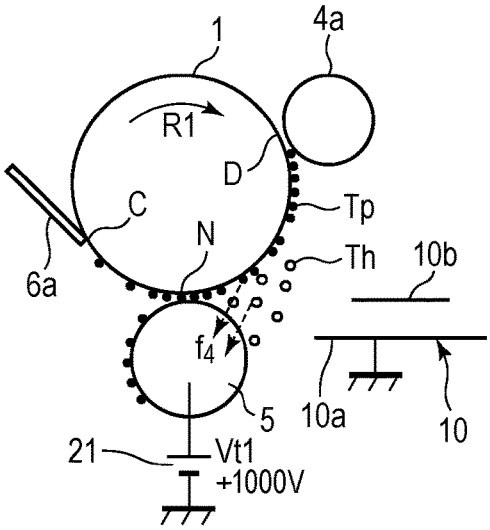
Figure 5C:
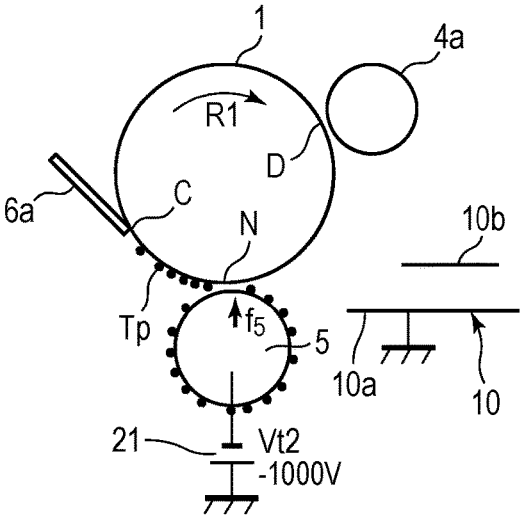

Next, the pass-through bias Vt1 that is applied to the transfer roller 5 during the supply operation will be described in more detail. FIG. 5A, FIG. 5B and FIG. 5C are schematic diagrams of the vicinity of the transfer unit N for describing the working effect of the present embodiment.

Note that, in the present embodiment the conveyance guide 10 is formed of an electrically conductive material (metal, electrically conductive plastic or the like), and is electrically grounded (connected to a ground). Further, in the present embodiment, the conveyance guide 10 is not disposed close enough to the transfer roller 5 or the photosensitive drum 1 to affect the electric potential distribution in the vicinity of the transfer unit N.

As illustrated in FIG. 5A, conventionally, a bias (for example, around −1000V) with the same polarity as the normal charge polarity of the toner is applied to the transfer roller 5 at least during a period in which toner Tp of a toner band on the photosensitive drum 1 passes through the transfer unit N. Thereby, adherence of the toner Tp of the toner band to the transfer roller 5 can be suppressed. On the other hand, on the upstream side of the transfer unit N in the rotational direction of the photosensitive drum 1, some of the toner Tp of the toner band that was charged to a negative polarity flies off from the photosensitive drum 1 and floats in the vicinity of the transfer unit N (hereunder, this toner is also referred to as "floating toner"). A force f1 in a direction away from the transfer roller 5 acts on the floating toner Th due to an electric field action caused by an electric potential difference between the electric potential (−1000V) of the transfer roller 5 and the exposed portion potential VL (−100V) of the photosensitive drum 1. The floating toner Th also receives a force f2 in the gravitational direction. Consequently, a force f3 in the direction of the resultant force of the aforementioned force f1 and force f2 acts on the floating toner Th, and ultimately the floating toner Th falls and piles up locally on the conveyance guide 10 disposed on the upstream side of the transfer unit N in the conveyance direction of the recording material P. In the present embodiment, the floating toner Th is liable to adhere in the vicinity of the end on the downstream side in the conveyance direction of the recording material P of the downstream guide unit 10*a*.

Therefore, in the present embodiment, as illustrated in FIG. 5B, during a period from when development of a toner band is started until the toner Tp of the toner band on the photosensitive drum 1 finishes passing through the transfer unit N, the pass-through bias Vt1 (+1000V) of a reverse polarity to the normal charge polarity of the toner is applied to the transfer roller 5. Thereby, by an electric field action caused by an electric potential difference between the electric potential (+1000V) of the transfer roller 5 and the exposed portion potential VL (−100V) of the photosensitive drum 1, a force f4 that attracts the floating toner Th to the transfer roller acts on the floating toner Th that was charged with a negative polarity.

Further, in the present embodiment, as illustrated in FIG. 5C, from the time that the toner Tp of the toner band has finished passing through the transfer unit N onward (and before starting the next image forming), the cleaning bias Vt2 (for example, −1000V) with the same polarity as the normal charge polarity of the toner is applied to the transfer roller 5. Thereby, the toner Tp of the toner band that adhered to the transfer roller 5 is caused to move from the transfer roller 5 to the photosensitive drum 1 by a force f5 produced by an electric field action between the transfer roller 5 and the photosensitive drum 1.

Table 1 shows results of an experiment that compared smears due to toner on the recording material P caused by the supply operation with respect to a conventional example, the present embodiment and comparative examples 1 and 2. For the present embodiment, during the supply operation, as described above, the pass-through bias Vt1 (+1000V) and the cleaning bias (−1000V) were applied to the transfer roller 5. In the conventional example, during the supply operation, a bias of −1000V was applied to the transfer roller 5 during a period from when development of the toner band was started until the toner of the toner band on the photosensitive drum 1 finished passing through the transfer unit N. In comparative example 1, similarly to the present embodiment, the pass-through bias Vt1 and the cleaning bias Vt2 were applied to the transfer roller 5 during the supply operation, however the pass-through bias Vt1 was set to +2000V that is the same as the transfer bias at the image forming time. Further, in comparative example 2, similarly to the present embodiment, the pass-through bias Vt1 and the cleaning bias Vt2 were applied to the transfer roller 5 during the supply operation, however the pass-through bias Vt1 was set to −100V that is the same as the exposed portion potential VL.

In the present experiment, the toner band was made a solid image having a length of 210 mm in the longitudinal direction and a length of 90 mm in the short-side direction. Further, smears (smears on the front side and rear side of a paper sheet) caused by toner on recording materials P output by printing performed immediately after the supply operation ended were compared. The smears on the recording material P that were compared in the present experiment were of two kinds. The first kind was a smear caused by toner of the toner band that adhered to the conveyance guide 10 adhering to the recording material P. The second kind was a smear caused by toner of the toner band that adhered to the transfer roller 5 and was not completely cleaned off adhering to the recording material P. These two kinds of smears were separately compared, and for each kind of smear a case where the smear did not occur was evaluated as "Not Occurred", a case where the smear occurred slightly was evaluated as "Slightly Occurred" and a case where the smear occurred at a noticeable level was evaluated as "Occurred."

Note that, in the present embodiment and in comparative examples 1 and 2, immediately after the toner of the toner band on the photosensitive drum 1 passed through the transfer unit N, the cleaning bias Vt2 of −1000V was applied throughout a time period corresponding to a period in which the transfer roller 5 performed five rotations. In order to compare the extent of adherence of toner to the transfer roller 5 depending on differences in the pass-through bias Vt1, these settings for the value and application time period of the cleaning bias Vt2 were used as the minimum required settings for cleaning the transfer roller 5.

TABLE 1

| | Conventional Example | Comparison Example 1 | Present Embodiment | Comparison Example 2 |
|---|---|---|---|---|
| Pass-through Bias Vt1 | −1000 V | −100 V | 1000 V | 2000 V |
| Smear 1 (Smear of conveyance guide) | Occurred | Slightly Occurred | Not Occurred | Not Occurred |
| Smear 2 (Smear of transfer roller) | Not Occurred | Not Occurred | Not Occurred | Slightly Occurred |

In the conventional example, it was difficult for toner of the toner band to adhere to the transfer roller 5, and smearing of the recording material P due to smearing of the transfer roller 5 did not occur. On the other hand, floating toner easily adhered to the conveyance guide 10, and smearing of the recording material P due to smearing of the conveyance guide 10 occurred.

In comparative example 1, it was difficult for toner of the toner band to adhere to the transfer roller 5, and smearing of the recording material P due to smearing of the transfer roller 5 did not occur. On the other hand, because floating toner adhered to the conveyance guide 10, although not to the same extent as in the conventional example, smearing of the recording material P due to smearing of the conveyance guide 10 slightly occurred.

In comparative example 2, the effect of attracting toner of the toner band to the transfer roller 5 was large and hence smearing of the recording material P due to smearing of the conveyance guide 10 did not occur. On the other hand, because a large amount of toner of the toner band adhered to the transfer roller 5, the cleaning performed for five rotations of the transfer roller 5 was inadequate, and smearing of the recording material P due to smearing of the transfer roller 5 occurred.

In the case of the present embodiment, the effect of attracting toner of the toner band to the transfer roller 5 was not as large as in comparative example 2, and toner of the toner band did not adhere to the transfer roller 5 in as large an amount as in comparative example 2. Consequently, because the transfer roller 5 was adequately cleaned by the cleaning performed for five rotations, smears on the front side of the paper sheet that were caused by smearing of the transfer roller 5 did not occur. Further, in the case of the present embodiment, floating toner was attracted in a proper amount to the transfer roller 5 and it became difficult for the floating toner to adhere to the conveyance guide 10. Therefore, smearing of the recording material P that was caused by smearing of the conveyance guide 10 did not occur.

Thus, according to the present embodiment, during a period from when development of a toner band is started until the toner of the toner band on the photosensitive drum 1 finishes passing through the transfer unit N, the following kind of pass-through bias Vt1 is applied to the transfer roller 5. That is, the pass-through bias Vt1 is such that the relation between the electric potential of the transfer roller 5 and the electric potential of the photosensitive drum 1 is "electric potential of transfer roller 5>electric potential of photosensitive drum 1." Thereby, the floating toner Th that was charged with a negative polarity that is in the vicinity of the transfer unit N is attracted to the transfer roller 5, and adherence of the floating toner Th to the conveyance guide 10 can be suppressed. However, it is not preferable to make the pass-through bias Vt1 extremely high. If the pass-through bias Vt1 is equal to or higher than the transfer bias Vt0 at an image forming time, there is a possibility that toner of the toner band will excessively adhere to the transfer roller 5 when the toner band on the photosensitive drum 1 passes through the transfer unit N, and smearing of the recording material P that is due to smearing of the transfer roller 5 will occur. As a method to avoid the aforementioned situation, although it is conceivable to prolong the cleaning of the transfer roller 5, this method is not preferable since the downtime will become longer. That is, in the present embodiment, the pass-through bias Vt1 is set as a bias that is at least a larger value than the exposed portion potential VL of the photosensitive drum 1. Further, the pass-through bias Vt1 is preferably set as a bias of a smaller value than the transfer bias Vt0 at an image forming time.

Note that, in a case where the normal charge polarity of the toner is a positive polarity, the pass-through bias Vt1 is at least set as a bias of a smaller value than the exposed portion potential VL of the photosensitive drum 1. Further, in this case, preferably, the pass-through bias Vt1 is set as a bias of a larger value than the transfer bias Vt0 at an image forming time.

That is, irrespective of the polarity of the toner, the pass-through bias Vt1 is made at least a bias that has the same polarity as the normal charge polarity of the toner and whose absolute value is less than the exposed portion potential VL of the photosensitive drum 1, or is made a bias of reverse polarity to the normal charge polarity of the toner. Further, irrespective of the polarity of the toner, the pass-through bias Vt1 is preferably made a bias that has the same polarity as the transfer bias Vt0 at an image forming time and whose absolute value is less than the absolute value of the transfer bias Vt0. Thereby, even if toner scatters from the photosensitive drum 1 during the supply operation, the toner is electrostatically attracted to the transfer roller 5 and thus smearing of the conveyance guide 10 is suppressed and, for example, it is possible to suppress smearing of the recording material P during printing immediately after the supply operation.

Note that, in a case where the electric potential of the photosensitive drum 1 changes during the supply operation, the pass-through bias Vt1 may be changed in accordance with the change so as to always satisfy the above described condition. In this case, the electric potential of the photosensitive drum 1 that is to be compared with the bias applied to the transfer roller 5 is the electric potential from the developing unit D to the transfer unit N in the rotational direction of the photosensitive drum 1.

Further, in the present embodiment, the pass-through bias Vt1 is applied to the transfer roller 5 during a period from when development of the toner band is started (the toner band starts to be formed on the image bearing member (on the photosensitive member)) until the toner of the toner band on the image bearing member has finished passing through the transfer unit N. Thereby, in a case where the image bearing member is a drum-like photosensitive member as in the present embodiment or the like, it is possible to suppress the occurrence of a situation in which, in the area from the developing unit D to the transfer unit N in the direction of movement of the image bearing member, toner on the image bearing member flies off and adheres to members in the vicinity of the transfer unit N, and hence this configuration is preferable. However, in some cases toner of the toner band that has been conveyed as far as the vicinity of the transfer unit N is liable to adhere to members in the vicinity of the transfer unit N. Therefore, by applying the pass-through bias Vt1 to the transfer roller 5 at least during a period in which the toner of the toner band on the image bearing member is passing through the transfer unit N, adherence of toner of the toner band to members in the vicinity of the transfer unit N can be adequately suppressed. The term "at least during a period in which the toner of the toner band on the image bearing member is passing through the transfer unit N" refers to a period from when the tip in the direction of movement of the image bearing member of the toner band on the image bearing member arrives at the transfer unit N until the back end in the direction of movement of the image bearing member of the toner band on the image bearing member finishes passing through the transfer unit N.

Embodiment 2

Next, another embodiment of the present invention will be described. The fundamental configuration and operations of the image forming apparatus of the present embodiment are the same as in Embodiment 1. Accordingly, components in the image forming apparatus of the present embodiment that have the same or corresponding functions or configurations as components of the image forming apparatus of Embodiment 1 are denoted by the same reference characters as in Embodiment 1 and a detailed description of such components is omitted hereunder.

In the present embodiment, a case is described in which the conveyance guide 10 is disposed sufficiently adjacent to the transfer roller 5 or the photosensitive drum 1 to affect the electric potential distribution in the vicinity of the transfer unit N.

Figure 6:
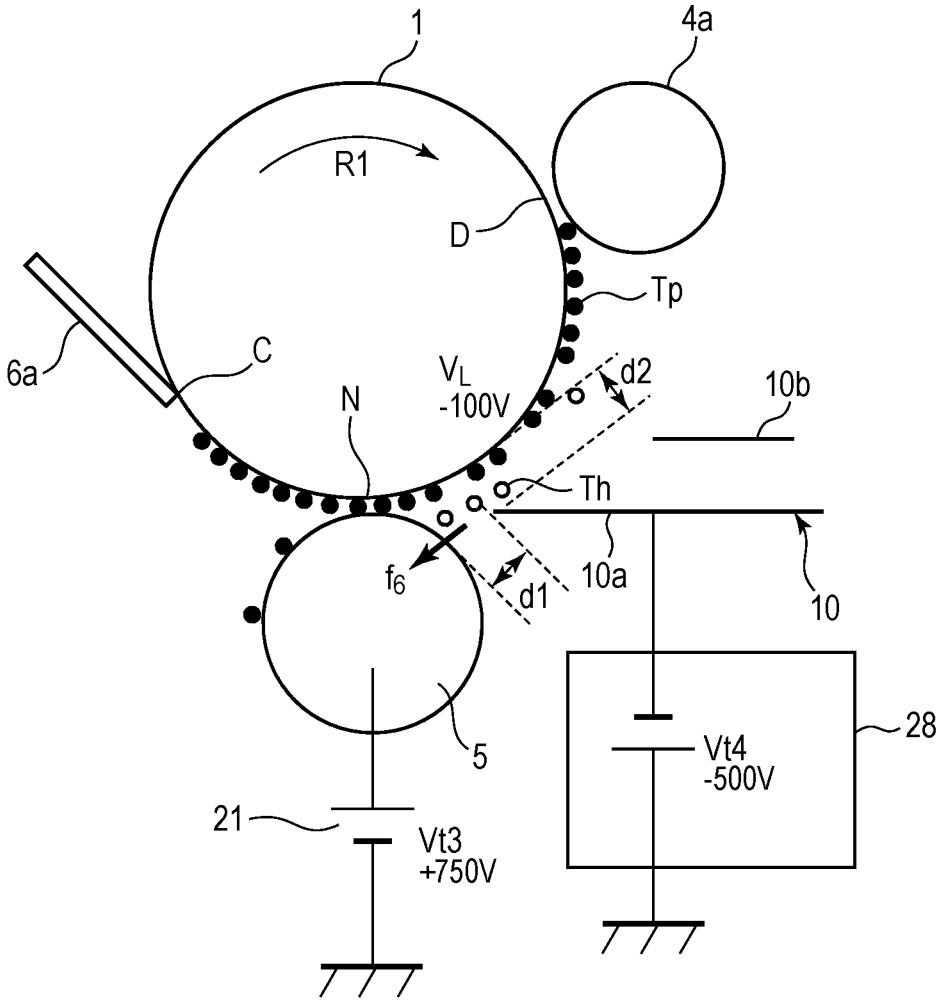
FIG. 6 is a schematic diagram for describing a working effect of another embodiment.

FIG. 6 is a schematic diagram of the vicinity of the transfer unit N for describing working effects of the present embodiment. In the present embodiment, for reasons such as stabilizing the behavior of the recording material P in the vicinity of the transfer unit N, the conveyance guide 10 is disposed in closer proximity to the transfer roller 5 and the photosensitive drum 1 than in Embodiment 1. In the present embodiment, a distance (shortest distance) d1 between the tip on the downstream side in the conveyance direction of the recording material P of the conveyance guide 10 (particularly, the downstream guide unit 10*a*) and the transfer roller 5 is 2.6 mm, and a distance (shortest distance) d2 between the aforementioned tip and the photosensitive drum 1 is 2.0 mm.

Further, in the present embodiment, the conveyance guide 10 is formed of electrically conductive material (metal, electrically conductive plastic or the like), and a guide power supply (high voltage power supply circuit) 28 is connected thereto. In the present embodiment, during the period from when development of a toner band is started in the supply operation until the toner Tp of the toner band on the photosensitive drum 1 finishes passing through the transfer unit N, a guide bias Vt4 that is a direct-current voltage with the same polarity as the normal charge polarity of the toner is applied to the conveyance guide 10.

On the other hand, similarly to Embodiment 1, during the period from when development of a toner band is started in the supply operation until the toner Tp of the toner band on the photosensitive drum 1 finishes passing through the transfer unit N, a predetermined pass-through bias Vt3 that is a direct-current voltage is applied to the transfer roller 5. Note that, because the value of the pass-through bias in the present embodiment is different from the value of the pass-through bias in Embodiment 1, the value of the pass-through bias in the present embodiment is described as "Vt3." Further, in the present embodiment, similarly to Embodiment 1, from the time that the toner Tp of the toner band on the photosensitive drum 1 finishes passing through the transfer unit N onward, the cleaning bias Vt2 (for example, −1000V) that is a direct-current voltage with the same polarity as the normal charge polarity of the toner is applied to the transfer roller 5.

As illustrated in FIG. 6, some of the toner Tp of the toner band flies off from the photosensitive drum 1 and floats in the vicinity of the transfer unit N. A force f6 produced by the action of an electric field formed by the respective electric potentials of the transfer roller 5, the photosensitive drum 1 and the conveyance guide 10 acts on the floating toner Th. In the present embodiment, the exposed portion potential VL of the photosensitive drum 1 is −100V. On the other hand, the electric potential of the transfer roller 5 and the electric potential of the conveyance guide 10 are determined by the applied pass-through bias Vt3 and guide bias Vt4, respectively. In the present embodiment the pass-through bias Vt3 is set as +750V, and the guide bias Vt4 is set as −500V. That is, in the present embodiment, the aforementioned values are set so that the relation between the value of the pass-through bias Vt3 and the value of the guide bias Vt4 is "Vt3>Vt4." Thereby, the floating toner Th that was charged with a negative polarity is attracted to the transfer roller 5, and thus smearing of the conveyance guide 10 can be suppressed. This situation is described in more detail hereunder.

Table 2 shows the results of comparing smears on the recording material P in cases where the value of the pass-through bias Vt3 and the value of the guide bias Vt4 were changed with respect to the configuration of the present embodiment. The smears on the recording material P that were compared in the present experiment were smears caused by toner of the toner band that adhered to the conveyance guide 10 adhering to the recording material P. Setting of the toner band, and the method for evaluating smears on the recording material P and the like were the same as in the experiment for which the results in Table 1 described in Embodiment 1 were obtained.

TABLE 2

| Guide Bias | Pass-through Bias Vt1 | | | | |
|---|---|---|---|---|---|
| Vt4 | −1000 V | −500 V | 0 V | 500 V | 750 V |
| −500 V | Occurred | Slightly Occurred | Not Occurred | Not Occurred | Not Occurred (the present embodiment) |
| 0 V | Occurred | Occurred | Slightly Occurred | Not Occurred | Not Occurred |
| 500 V | Occurred | Occurred | Occurred | Slightly Occurred | Not Occurred |

As will be understood from Table 2, in a case where the relation between the value of the pass-through bias Vt3 and the value of the guide bias Vt4 is set so as to be "Vt3>Vt4", smears on the recording material P that were caused by smearing of the conveyance guide 10 did not occur. That is, even when the guide bias Vt4 is made −500V with the same polarity as the normal charge polarity as the toner, if the pass-through bias Vt3 is −1000V (<−500V), the floating toner Th that was charged with a negative polarity moves away from the transfer roller 5 and adheres to the conveyance guide 10. Conversely, even when the guide bias Vt4 is made +500V with reverse polarity to the normal charge polarity of the toner, by making the pass-through bias Vt3 +750V (>+500V), the floating toner Th with negative polarity is attracted to the transfer roller 5 and thus adherence thereof to the conveyance guide 10 is suppressed.

Thus, according to the present embodiment, during a period from when development of a toner band is started until the toner of the toner band on the photosensitive drum 1 finishes passing through the transfer unit N, the following kind of pass-through bias Vt3 is applied to the transfer roller 5. That is, the pass-through bias Vt3 is such that the relation between the electric potential of the transfer roller 5 and the electric potential of the conveyance guide 10 is "electric potential of transfer roller 5>electric potential of conveyance guide 10." Thereby, the floating toner Th that was charged with a negative polarity that is in the vicinity of the transfer unit N is attracted to the transfer roller 5, and adherence of the floating toner Th to the conveyance guide 10 can be suppressed. However, as described in Embodiment 1, preferably the pass-through bias Vt3 is made a bias of a larger value than the exposed portion potential VL of the photosensitive drum 1. Further, preferably the pass-through bias Vt3 is made a bias of a smaller value than the transfer bias Vt0 at an image forming time.

Note that, in a case where the normal charge polarity of the toner is a positive polarity, the pass-through bias Vt3 is set so that the aforementioned relation becomes "electric potential of transfer roller 5<electric potential of conveyance guide 10". However, in this case also, as described in Embodiment 1, preferably the pass-through bias Vt3 is made a bias of a smaller value than the exposed portion potential VL of the photosensitive drum 1. Further, in this case also, preferably the pass-through bias Vt3 is made a bias of a larger value than the transfer bias Vt0 at an image forming time.

That is, in the case of a configuration in which the conveyance guide 10 affects the electric potential distribution in the vicinity of the transfer unit N, irrespective of the polarity of the toner, the pass-through bias Vt3 is made a bias that, in comparison to the electric potential of the conveyance guide 10, has a large value on the reverse polarity side to the normal charge polarity of the toner. Further, similarly to Embodiment 1, preferably, irrespective of the polarity of the toner, the pass-through bias Vt3 is made a bias that has the same polarity as the normal charge polarity of the toner and whose absolute value is less than the exposed portion potential VL of the photosensitive drum 1, or is made a bias of reverse polarity to the normal charge polarity of the toner. Further, preferably, irrespective of the polarity of the toner, the pass-through bias Vt3 is made a bias that has the same polarity as the transfer bias Vt0 at an image forming time and whose absolute value is less than the absolute value of the transfer bias Vt0. Thereby, smearing of the conveyance guide 10 with toner is suppressed, and for example it is possible to suppress the occurrence of smears on the recording material P during printing immediately after the supply operation.

Note that, in a case where the electric potential of the conveyance guide 10 changes during the supply operation, the pass-through bias Vt3 may be changed in accordance with the change so as to always satisfy the above described condition.

Further, in the present embodiment, the pass-through bias Vt3 is applied to the transfer roller 5 during a period from when development of the toner band is started (the toner band starts to be formed on the image bearing member) until the toner of the toner band on the image bearing member has finished passing through the transfer unit N. Further, during the same period, the guide bias (guide voltage) Vt4 is applied to the conveyance guide 10. However, as described in Embodiment 1, in some cases an adequate effect is obtained as long as the pass-through bias Vt3 and the guide bias Vt4 are applied at least while the toner of the toner band on the image bearing member is passing through the transfer unit N.

[Other]

Although the present invention has been described in accordance with specific embodiments, the present invention is not limited to the above described embodiments.

Figure 7:
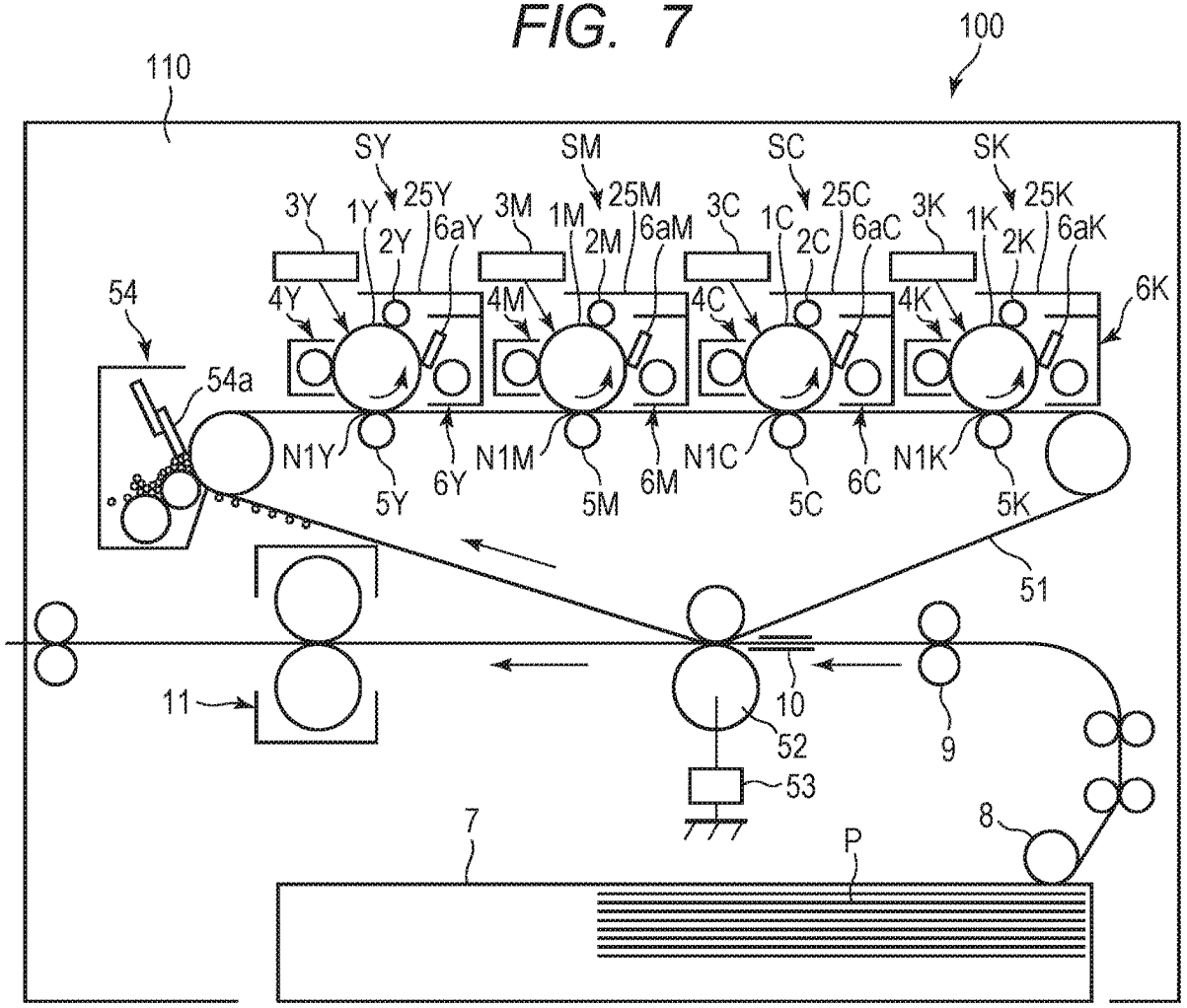
FIG. 7 is a schematic cross-sectional view of another example of an image forming apparatus.

Although in the above described embodiments the present invention is applied in relation to a transfer unit in an image forming apparatus in which a toner image is transferred directly onto a recording material from a photosensitive member as an image bearing member, the present invention is not limited thereto. For example, FIG. 7 is a schematic cross-sectional view of one example of a tandem-type image forming apparatus that employs an intermediate transfer system. In FIG. 7, components having the same or corresponding functions or configurations as components of the foregoing embodiments are denoted by the same reference characters as in the foregoing embodiments. Further, the characters Y, M, C and K are respectively added to the end of the reference characters of components that have the same or corresponding functions or configurations as components of the foregoing embodiments and that are provided for each of the colors of yellow, magenta, cyan and black.

The image forming apparatus 100 in FIG. 7 has four image forming units S that each include the photosensitive drum 1 as a first image bearing member, and an intermediate transfer belt 51 as a second image bearing member. The intermediate transfer belt 51 is an example of an intermediate transfer member that conveys a toner image that underwent a primary transfer thereto from the photosensitive drum 1 to be subjected to a secondary transfer to the recording material P. A toner image formed on the photosensitive drum 1 of each image forming unit S is subjected to a primary transfer onto the intermediate transfer belt 51 by an action of respective primary transfer rollers 5 at each primary transfer unit N1. Thereafter, the toner images on the intermediate transfer belt 51 are subjected to a secondary transfer onto the recording material P by a secondary transfer roller 52 that is a roller-type secondary transfer member as a secondary transfer device at the secondary transfer unit N2. A secondary transfer power supply 53 is connected to the secondary transfer roller 52, and at the time of a secondary transfer a secondary transfer bias (secondary transfer voltage) that is a direct-current voltage with a reverse polarity to the normal charge polarity of the toner is applied. Toner remaining on the intermediate transfer belt 51 after the secondary transfer process is removed from the intermediate transfer belt 51 and collected by a belt cleaning apparatus 54 as an intermediate transfer member cleaning unit. The belt cleaning apparatus 54 has a cleaning blade 54*a* as a cleaning member that is disposed in contact with the intermediate transfer belt 51 so as to be in a counter direction with respect to the direction of movement of the intermediate transfer belt 51. In the image forming apparatus 100, for example, a unit (intermediate transfer belt unit) including the intermediate transfer belt 51 and the belt cleaning apparatus 54 is sometimes detachably attached to the apparatus main body 110. Further, in the image forming apparatus 100, each image forming unit S constitutes a toner image forming unit for forming a toner image on the intermediate transfer belt 51.

If a frictional force between the cleaning blade 54*a* of the belt cleaning apparatus 54 and the intermediate transfer belt 51 becomes excessive, similar problems as the problems described with regard to the foregoing embodiments may sometimes arise. To suppress the occurrence of such problems, a toner band formed on at least one of the plurality of photosensitive drums 1 can be transferred to the intermediate transfer belt 51 and allowed to pass through the secondary transfer unit N2 to supply toner of the toner band to a contact portion between the cleaning blade 54*a* and the intermediate transfer belt 51. In this case, the problem that the conveyance guide 10 is smeared by toner that flies off from the intermediate transfer belt 51 in the vicinity of the secondary transfer unit N2 may occur. Therefore, the present invention can be applied in relation to the secondary transfer unit N2. That is, in this case, a pass-through bias having reverse polarity to the normal charge polarity of the toner, preferably, a bias having the same polarity as the secondary transfer bias at an image forming time and whose absolute value is less than the absolute value of the secondary transfer bias, is applied to the secondary transfer roller 52. Further, in addition to or instead of this condition, a pass-through bias that, in comparison to the electric potential of the conveyance guide 10, has a large value on the reverse polarity side to the normal charge polarity of the toner is applied to the secondary transfer roller 52. Thereby, similar effects as in the foregoing embodiments can be obtained.

Further, although the present invention is favorably used in particular in a case where the cleaning member is a blade-shaped member, the cleaning member is not limited to a blade-shaped member. For example, in a case of using a cleaning member with respect to which it is desirable to execute a supply operation that supplies toner to a contact portion between the cleaning member and an image bearing member to reduce a frictional force between the cleaning member and the image bearing member, such as in a case of using a block-shaped (pad-shaped) cleaning member, similar effects to the effects described above can be expected by applying the present invention.

According to the present invention, smearing of members in the vicinity of a transfer unit with toner that is due to an operation that is performed to supply toner to a contact portion between a cleaning member and an image bearing member at a non-image forming time can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-196666, filed Oct. 4, 2016, which is hereby incorporated by reference herein in its entirety.

What is claimed is:

1. An image forming apparatus comprising:

a photosensitive member;

a charge device configured to charge the photosensitive member;

an exposure device configured to expose the photosensitive member that is charged and form an electrostatic image;

a developing device configured to supply toner to the electrostatic image to form a toner image;

a transfer member configured to cause the toner image to be transferred from the photosensitive member onto a recording material at a transfer unit;

a transfer power supply configured to apply a voltage to the transfer member;

a cleaning member disposed in contact with the photosensitive member, the cleaning member configured to remove toner adhering to the photosensitive member; and a control unit configured to cause a supply operation to be executed at a non-imge forming time, the supply operation including forming a predetermined toner image on the photosensitive member and supplying toner of the predetermined toner image to a contact portion between the cleaning member and the photosensitive member, wherein at least during a period in which toner of the predetermined toner image on the photosensitive member passes through the transfer unit during the supply operation, the control unit causes a pass-through voltage, which is a voltage having a same polarity as a normal charge polarity of the toner and having an absolute value that is less than an electric potential of a portion that is exposed by the exposure device of the photosensitive member, to be applied from the transfer power supply to the transfer member.

2. An image forming apparatus according to claim 1, wherein the control unit causes a change of the pass-through voltage according to a change in an electric potential of a portion exposed by the exposure device of the photosensitive member.

3. An image forming apparatus according to claim 1, wherein the control unit causes the pass-through voltage to be applied during a period from when the predetermined toner image starts to be formed on the photosensitive member until toner of the predetermined toner image on the photosensitive member finishes passing through the transfer unit.

4. An image forming apparatus according to claim 1, wherein the pass-through voltage is a voltage that has a same polarity as a transfer voltage that is applied to the transfer member from the transfer power supply at a time of the transfer and whose absolute value is less than an absolute value of the transfer voltage.

* * * * *